United States Patent [19]

Abe

[11] Patent Number: 4,742,584

[45] Date of Patent: May 10, 1988

[54] WATER CURRENT AND AIR BUBBLE GENERATING APPARATUS FOR BATH

[75] Inventor: Masaki Abe, Osaka, Japan

[73] Assignee: ABE Co., Ltd., Osaka, Japan

[21] Appl. No.: 17,094

[22] Filed: Feb. 20, 1987

Related U.S. Application Data

[63] Continuation of Ser. No. 766,283, Aug. 16, 1985, abandoned.

[30] Foreign Application Priority Data

Sep. 5, 1984 [JP] Japan ..... 59-134645[U]
Oct. 22, 1984 [JP] Japan ..... 59-159936[U]

[51] Int. Cl.[4] ..... A61H 33/02
[52] U.S. Cl. ..... 4/542; 261/DIG. 75
[58] Field of Search ..... 4/541, 542, 544; 128/66; 261/36.1, 121 M, DIG. 75

[56] References Cited

U.S. PATENT DOCUMENTS 3,286,712 11/1966 Roden ..... 4/544 X
3,474,469 10/1969 Steltz ..... 4/544
3,806,964 4/1974 Vanegas et al. ..... 4/542
3,911,505 10/1975 Zaborowsky ..... 4/544
4,040,415 8/1977 Kulisch ..... 128/66
4,138,330 2/1979 Garrett ..... 261/DIG. 75 X
4,282,866 8/1981 Miffitt ..... 4/544 X
4,563,782 1/1986 Dijkhuizen ..... 4/542

*Primary Examiner*—Charles E. Phillips
*Attorney, Agent, or Firm*—Birch, Stewart, Kolasch & Birch

[57] ABSTRACT

In the inside of a main body case 4, a motor 10 and a pump 11 are contained. To the pump 11, a suction pipe 12 and an outlet pipe 14 are connected. Jet nozzles 17 are coupled to a portion of the outlet pipe 14. The tip portion of the suction pipe 12 is submerged in the hot water 13 of a bathtub 3 so that the hot water 13 is sucked up by the suction power of the pump 11. The hot water thus sucked up is sent out from an outlet of the pump 12 into the outlet pipe 14 so that it shoots out as jet currents from the jet nozzles 17 to the surface of the hot water 13. At this time, countless air bubbles are generated in the hot water 13 and when they are bursted, ultrasonic wave is generated to bring about various healthfull effects. The above stated components are all installed in a bathroom 2.

7 Claims, 8 Drawing Sheets

WATER CURRENT AND AIR BUBBLE GENERATING APPARATUS FOR BATH

This application is a continuation of application Ser. No. 766,283, filed on Aug. 16, 1985, now abandoned.

BACKGROUND OF THE INVENTION

1. Field of the Invention

The present invention relates to a water current and air bubble generating apparatus for bath and particularly to a water current and air bubble generating apparatus in which air bubbles are generated in the hot water in a bathtub by sending jet currents of water thereto.

2. Description of the Prior Art

Recently, various bathing methods have been developed for the purpose of securing good health and as one of them, a bathing method using a water current and air bubble generating apparatus in which countless fine air bubbles are generated by sending jet current of water into the hot water is known. It is known that the above stated air bubbles, when bursted, produce ultrasonic wave in a frequency range of 20 to 40 KHz, whereby various healthfull effects such as warming, massage and washing are brought about.

However, such conventional water current and air bubble generating apparatus were developed for business use and all of them had a large size. Consequently, for installation of such a conventional water current and air bubble generating apparatus, the pump, the motor and the like serving as a source for generation of jet currents of water are fixed outside the bathroom and the outlet pipe and the suction pipe of the pump are taken into the bathroom through penetrating holes bored in the wall of the bathroom. Thus, such a conventional water current and air bubble generating apparatus requires large-scale installation work, which causes a high cost in installation. In addition, sometimes such penetrating holes cannot be bored in the wall especially in the case of an ordinary family bathroom, which causes an obstruction to the popular use in ordinary family bathrooms.

SUMMARY OF THE INVENTION

Therefore, a principal object of the present invention is to provide a water current and air bubble generating apparatus for bath which can be easily installed in an existing bathroom without any particular installation work such as boring of holes and can be easily used in an ordinary family bathroom as well.

Briefly stated, in the present invention, a pump and a motor are contained in a case as a unit, which can be installed easily in a bathroom, an outlet pipe and a suction pipe being connected to the pump and jet nozzles being connected at the top end of the outlet pipe.

Since an apparatus of this invention can be installed without any particular installation work, the installation cost can be decreased and the apparatus can be also installed in an ordinary family bathroom without difficulty. In addition, since installation work is not particularly required, the apparatus of this invention can be used on the same day of purchase thereof.

In a preferred embodiment of this invention, a power source circuit including a step-down transformer is provided outside the bathroom and this power source circuit steps down the voltage of a commercial power source for example and then supplies the electric power to the motor. An advantage of this embodiment is that even if leakage of electricity occurs in the circuit unit provided outside the bathroom, there is little electric shock to the human body and a serious accient such as loss of life can be prevented.

In another preferred embodiment of this invention, a cylinder is provided around each jet nozzle so that the lower end of the cylinder is located at a position lower than the opening of the jet nozzle. An advantage of this embodiment is that since the lower end of the cylinder exists in the hot water, the noise which would be otherwise raised by collision of the jet current with the water surface can be decreased.

These object and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
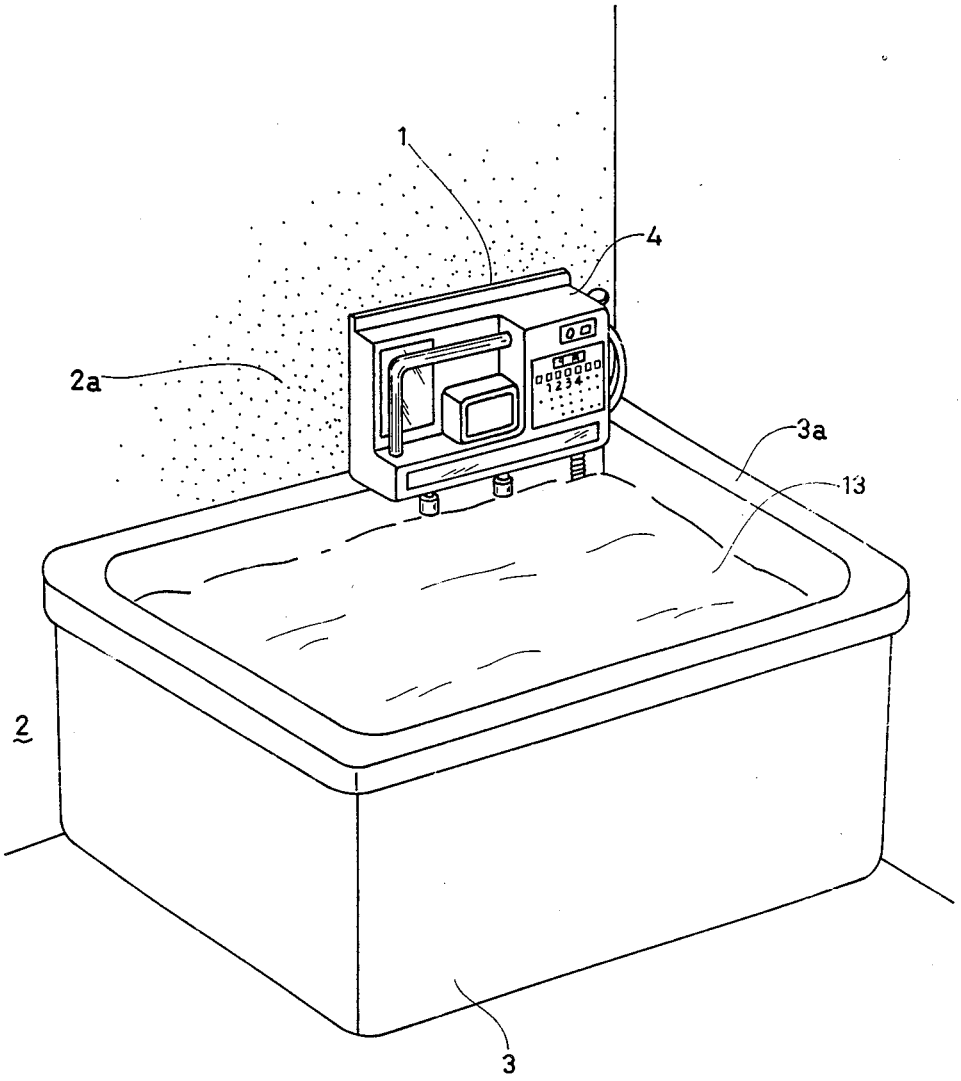
FIG. 1 is a perspective view showing the state in which a water current and air bubble generating apparatus of an embodiment of this invention is installed in a bathroom.
Figure 2:
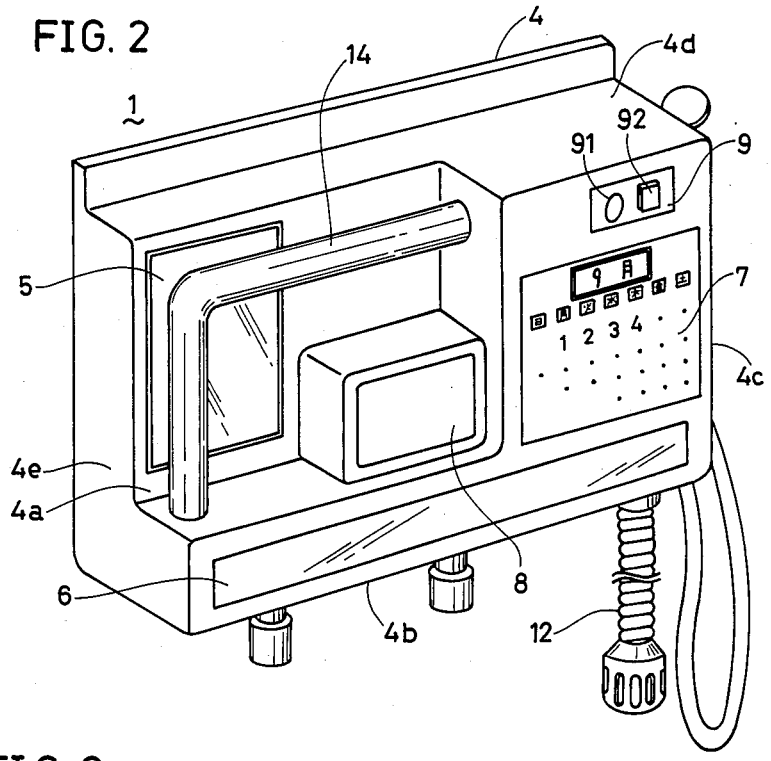
FIG. 2 is an enlarged perspective view of the water current and bubble generating apparatus shown in FIG. 1.
Figure 3:
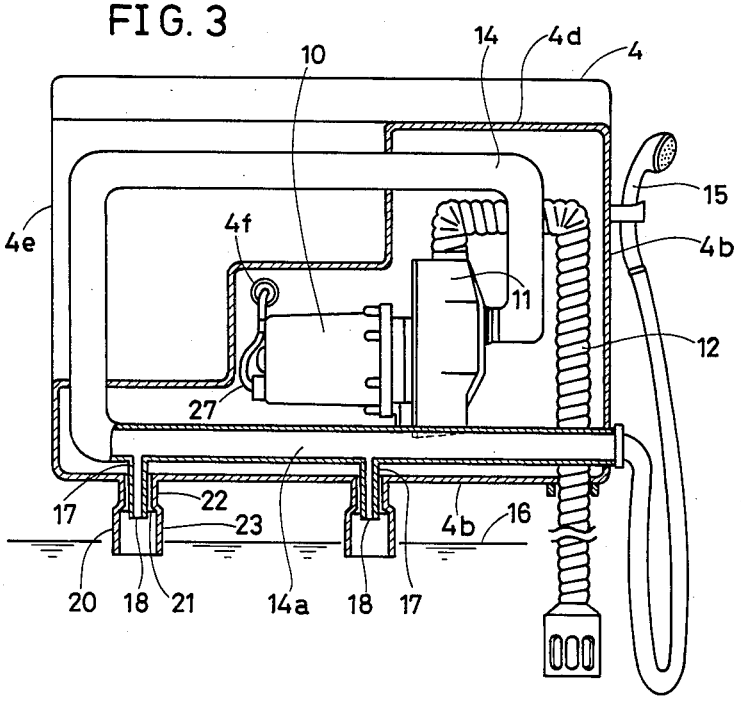
FIG. 3 is a partial sectional front view of the water current and air bubble generating apparatus shown in FIG. 1.

FIG. 1 is a perspective view showing the state in which a water current and air bubble generating apparatus of an embodiment of this invention is installed in a bathroom. FIG. 2 is an enlarged perspective view of the above stated water current and air bubble generating apparatus. FIG. 3 is a partial sectional front view of the above stated water current and air bubble generating apparatus. First, referring to these FIGS. 1 to 3, the structure of an embodiment of the present invention will be described. As shown in FIG. 1, the water current and air bubble generating apparatus 1 is placed on an edge portion 3*a* of a bathtub 3 and fixed to the wall 2*a* and the like of a bathroom 2 by means of fixing screws (not shown). This water current and air bubble generating apparatus 1 includes a main body case 4. This main body case 4 is for example in the form of a plastic box and on the front faces 4a of the main body case 4, an acrylic mirror 5, an elongate colored mirror 6, a perpetual calendar 7 and a landscape 8 are provided as accesories. These accesories may be changed for other suitable ones as required or may be omitted. Further, on the front face 4a of the main body case 4, a switch panel 9 is provided. This switch panel 9 comprises a pilot lamp 91 for indicating the ON-state of a power source circuit (to be described later) of the apparatus and an ON-OFF switch 92 for turning on or off the apparatus. As the ON-OFF switch 92, a luminous push-button switch is used.

In the inside of the above stated main body case 4, a motor 10 and a pump 11 driven by the motor 10 are contained. To the inlet of the pump 11, one end of a suction pipe 12 is connected. The other end of the suction pipe 12 projects to the outside from the bottom face 4b of the main body case 4 to be submerged in the hot water 13 in the bathtub 3. To the outlet of the pump 11, one end of the outlet pipe 14 is connected. The outlet pipe 14 first extends upward along the right side face 4b of the main case 4, then is bent at a right angle and extends to the left (in FIG. 4) along the upper face 4d of the main body case 4. Further, it is bent at a right angle and extends downward along the left side face 4e of the main body case 4 and then is bent at a right angle to extend to the right (in FIG. 4) along the bottom face 4b of the main body case 4. The other end of the outlet pipe 14 projects from the right side face 4b of the main body case 4 to the outside and at the top end thereof, a shower apparatus 15 is attached. In the outlet pipe 14, a portion extending in parallel with the bottom face 4b of the main body case 4, that is, a horizontal portion 14a parallel to the water surface 16 in the bathtub 3 includes a plurality of jet nozzles 17 at suitable intervals. These jet nozzles 17 are provided to be vertical with respect to the water surface 16 and serve to send jet currents of water to the water surface 16. In this embodiment, the tip portion (jet exit) of each jet nozzle 17 is located at a position higher than the water surface 16. The jet nozzles may be formed together with the outlet pipe 14 as one body or may be prepared as parts separate from the outlet pipe 14 so as to be coupled thereto at the time of assembling.

In this embodiment, cylinders 20 are provided on the bottom face 4b of the main body case 4 so as to surround the respective jet nozzles 17. Each cylinder 20 has a lower end located at a position lower than the tip portion 18 of the associated jet nozzle 17. The lower end of each cylinder 20 provide a space between the tip portion 18 and the water surface 16 and is submerged in the hot water 13. These cylinders 20 serve to deaden the noise produced by collision of jet currents of water with the water surface 16. A gap 21 is formed between each cylinder 20 and the outer surface of each associated jet nozzle 17. At the time of using the apparatus, air flows from the main body case 4 into the cylinders 20 through these gaps 21 which allow the passage of air. As a result, proper flow of the jet currents in the cylinders 20 can be obtained.

Figure 4:
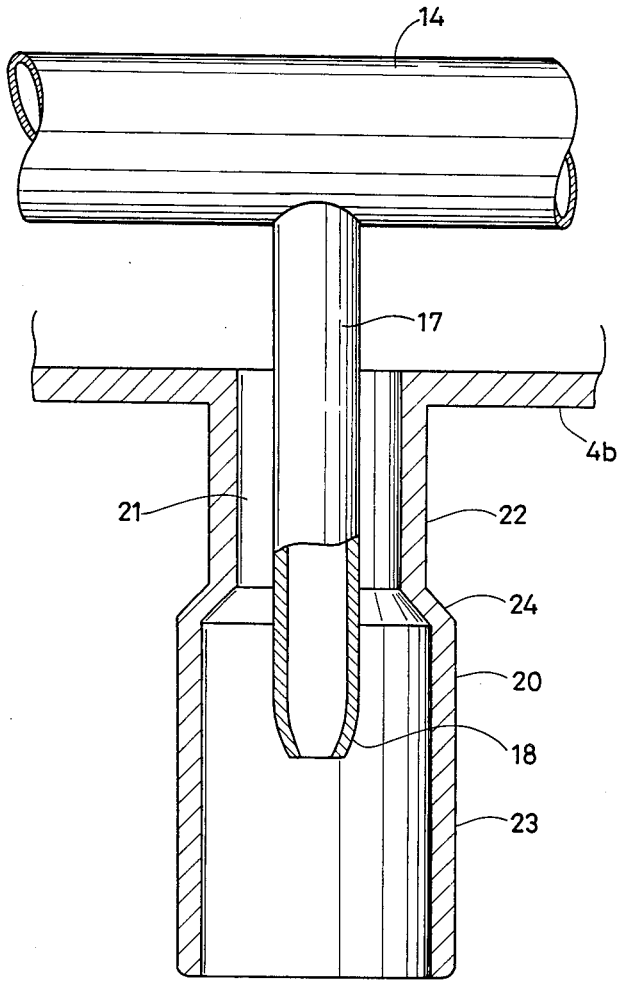
FIG. 4 is an enlarged partial sectional view of a jet nozzle and a cylinder shown in FIG. 3.

FIG. 4 is an enlarged partial view showing a nozzle 17 and a cylinder 20 as described above. As shown, the cylinder 20 has an upper portion 22 of a small diameter and a lower portion 23 of a large diameter, these portions 22 and 23 being connected through a conical portion 24. The cross-sectional area of the portion 22 of a small diameter is preferably 25 to 35% of that of the portion 23 of a large diameter in view of the effect of silencing the noise. As a result of an experiment comparing the case where such cylinders as described above were not provided and the case where cylinders each having a narrow portion of 19 mm in diameter and a wide portion of 34 mm in diameter were provided, it was ascertained that the noise which was 70 phons in the former case could be decreased to 62 phons in the latter case, where no inconvenience was caused to the conversation in the bathroom.

The cylinder 20 may be formed as a flexible one which can be adjusted according to the height of the water surface 16.

Figure 5:
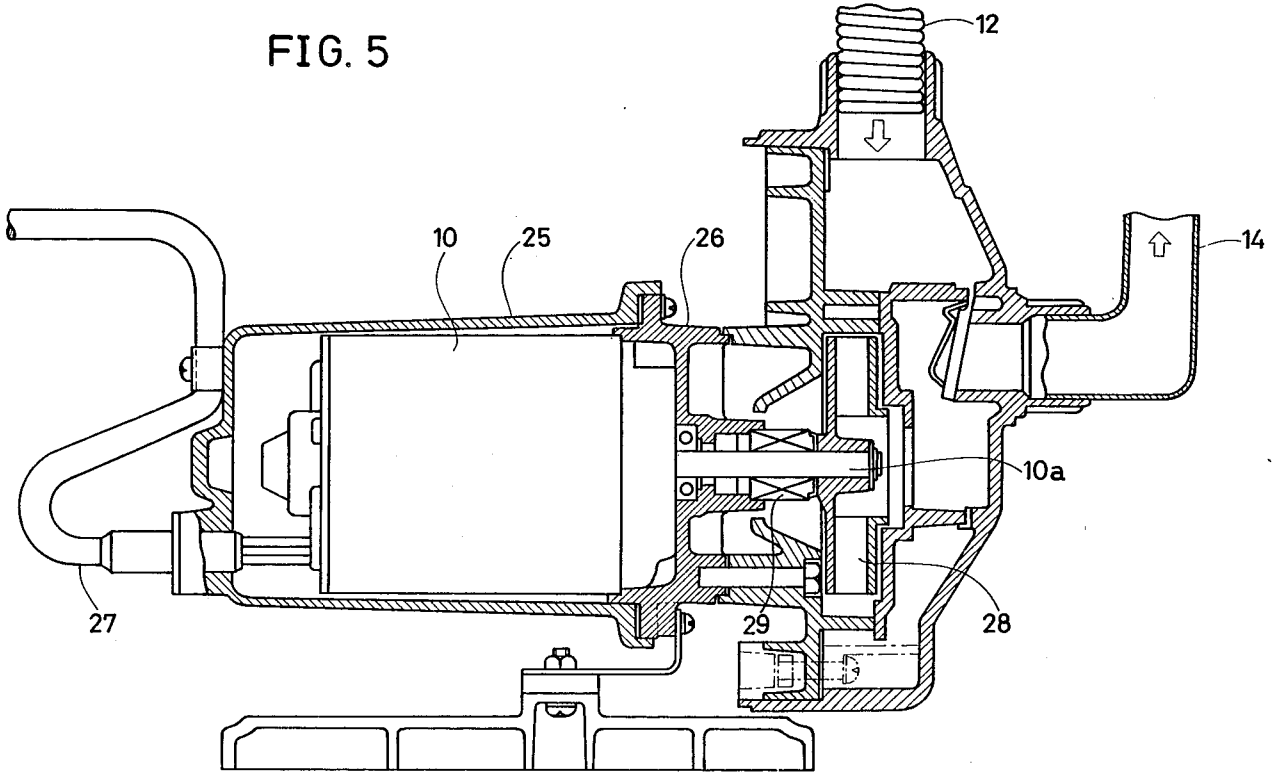
FIG. 5 is a partial sectional side view of the motor and the pump shown in FIG. 3.

FIG. 5 is a partial sectional side view of the motor 10 and the pump 11 shown in FIG. 3. In the figure, the motor 10 is contained in the motor case 25 and this motor case 25 is covered with a bracket 26 so as to be made completely watertight. A cord 27 is connected to the motor 10. This cord 27, kept watertight, is drawn from a side face of the motor case 10 to the outside thereof. The cord 27 drawn out is taken to the exterior of the main body case 4 through a hole in the back surface of the main body case 4, as shown in FIG. 3. The cord 27 thus drawn out to the exterior of the main body case 4 extends outside the bathroom so as to be connected to a power source circuit provided in a place other than the bathroom (for example, a dressing room). The wiring, of the cord 27 can be made through a small hole of only about 8 mm in diameter in the door frame of the bathroom for example, without any particular work on a large scale as required in a conventional apparatus. On the other hand, at the tip portion of a rotating shaft 10a projecting from the above stated bracket 26, an impeller 28 is connected. By the rotation of the impeller 28, the hot water 13 is sucked up. On the rotating shaft 10a, a mechanical seal 29 is attached in a portion between the bracket 26 and the impeller 28, whereby the watertight effect is further enhanced.

Thus, the motor 10 is made completely watertight and accordingly, leakage of electricity can be prevented almost perfectly.

Figure 6:
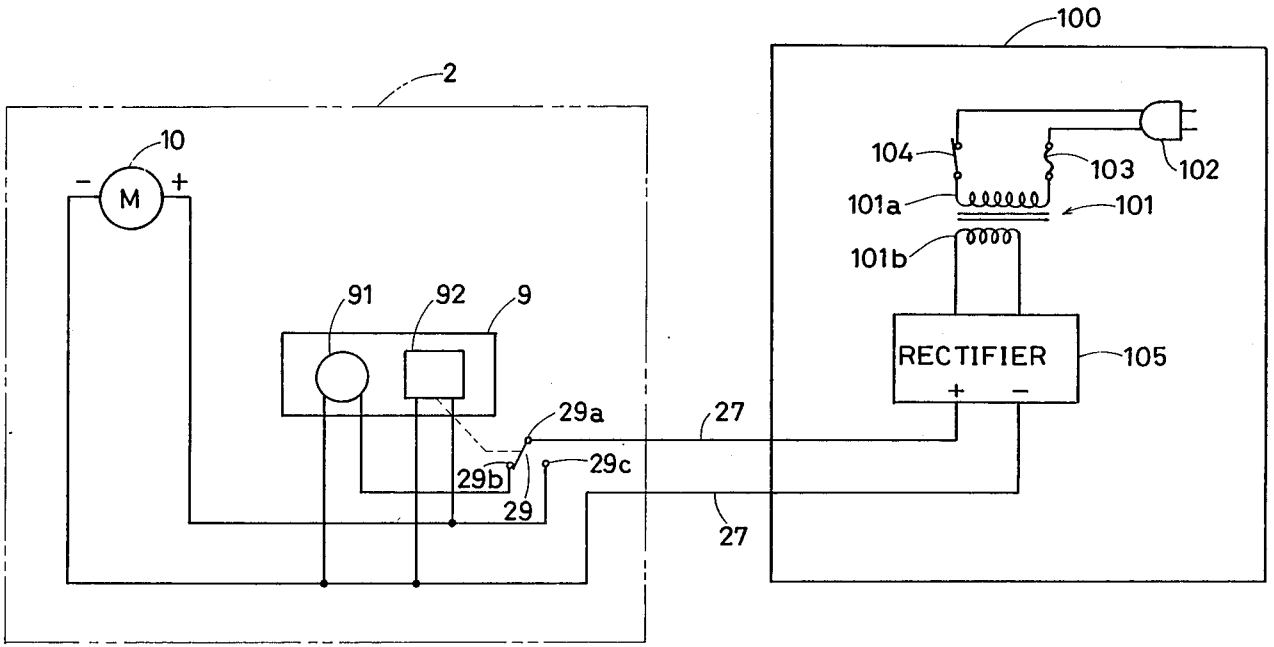
FIG. 6 is a schemtic block diagram showing an electric circuit of the embodiment shown in FIG. 1 to 5.

FIG. 6 is a schematic block diagram showing an electric circuit of the above described embodiment. Referring to FIG. 6, a power source circuit 100 is provided outside the bathroom 2. This power source circuit 100 includes a step-down transfromer 101. A plug 102 is connected to the primary coil 101a of the step-down transformer 101. Between the plug 102 and the primary coil 101a, a fuse 103 and a power source switch 104 are provided. On the other hand, the secondary coil 101b of the step-down transformer 101 is connected with a rectifier 105. To an output terminal of the rectifier 105, one end of the above stated cord 27 is connected. The other end of the cord 27 is taken into the bathroom 2. The plus line of the cord 27 connected to the plus output terminal of the rectifier 105 is connected to a terminal 29a of a switch 29. The switch 29 is turned to either side by the operation of the above stated ON-OFF switch 92 so that the terminals 29a and 29b or the terminals 29a and 29c are connected. The terminal 29b is connected to one end of a pilot lamp 91. The terminal 29c is connected to one end of a luminous lamp contained in the ON-OFF switch 92 as well as to the plus terminal of the motor 10. On the other hand, the minus line of the cord 27 connected to the minus output terminal of the rectifier 105 is connected to the other ends of the pilot lamp 91 and the ON-OFF switch 92 as well as to the minus terminal of the motor 10.

Now, the operation of this embodiment will be described. First, the plug 102 is put in an outlet of commercial power source (of 100 V, for example) not shown so that the power source switch 104 is turned on. As a result, stepped down AC voltage (20 V, for example) is induced in the secondary coil 101*b* of the step-down transformer 102. The AC voltage induced in the secondary coil 101*b* is applied to the rectifier 105 so that it is rectified as DC voltage. Now, let us assume that the terminals 29*a* and 29*b* of the switch 29 are connected. In this case, the output of the rectifier 105 is applied only to the pilot lamp 91 so that the pilot lamp 91 is turned on. At this time, the motor 10 is not driven. Then, when the ON-OFF switch 92 is turned on, the switch 29 is turned to the other side so that the terminals 29*a* and 29*c* are connected. As a result, the output of the rectifier 105 is applied to the luminous lamp of the ON-OFF 92 and the motor 10. Counsequently, the luminous lamp contained in the ON-OFF switch 92 is turned on and the motor 10 starts to rotate. By the rotation of the motor 10, the impeller 28 is rotated and the pump 11 is driven, so that the suction pipe 12 sucks up hot water 13 to supply it to the pump 11. The pump 11 sends out the hot water supplied from the suction pipe 12 to the outlet pipe 14. Thus, hot water flows in the outlet pipe 14 so as to shoot out as a jet current from the tip poriton 18 of each jet nozzle 17. The hot water thus shooting out is thrown onto the water surface 16 with air in the vicinity being drawn thereinto. As a result, countless fine air bubbles are generated in the hot water 13. When these air bubbles are bursted, ultrasonic wave is generated to bring about various healthful effects such as warming, massage and washing.

Then, when the ON-OFF switch 92 is pressed again, the switch 29 is turned to another side so that the terminals 29*a* and 29*b* are connected. In consequence, the pilot lamp 91 is turned on again and the apparatus stops operation. The luminous lamp contained in the ON-OFF switch 92 is turned off.

Thus, in the above described embodiment, the power source circuit 100 is provided in a place other than the bathroom 2 and accordingly, such an accident as leakage of electricity due to splashes of hot water 13 onto the power source circuit 100 can be completely prevented. In addition, since the step-down transformer 101 is included in the power source circuit 100 to provides insulation between the commercial power source and the water current and air bubble generating apparatus 1 and to step down the voltage of the commercial power source, a serious danger to life can be completely prevented even if leakage of electricity occurs in the water current and bubble generating apparatus 1.

Although in the above described embodiment, a DC motor is used as the motor 10, an induction motor or the like may be used instead and in such case, the rectifier 105 can be omitted.

Figure 7:
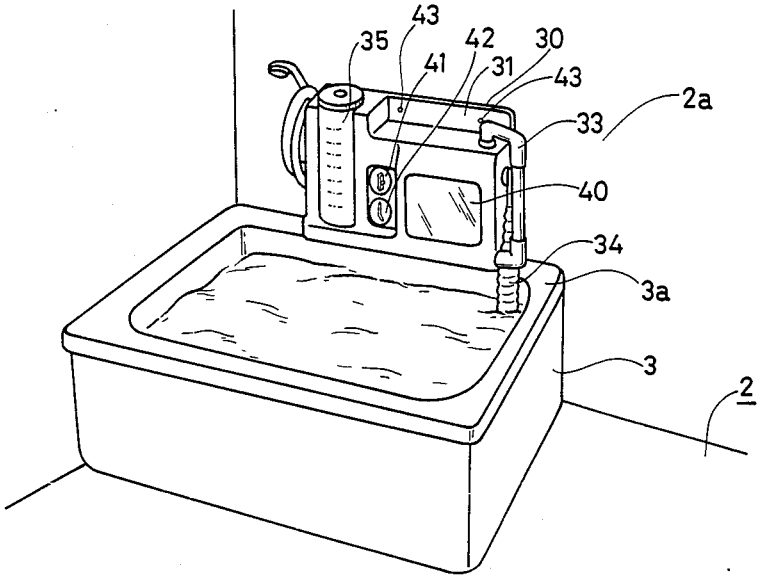
FIG. 7 is a perspective view showing the state in which a water current and air bubble generating apparatus of another embodiment of this invention is installed in a bathroom.
Figure 8:
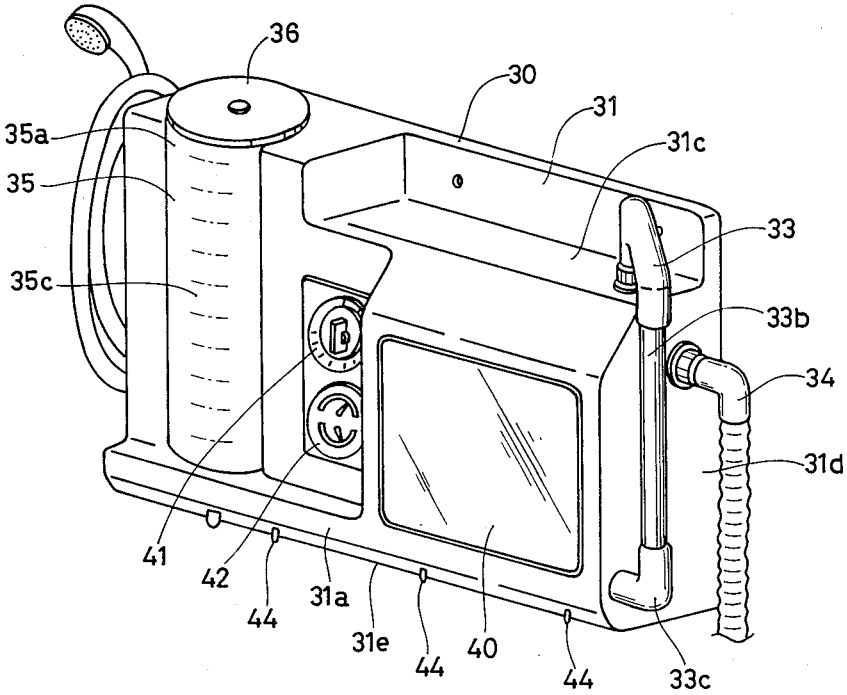
FIG. 8 is an enlarged perspective view of the water current and air bubble generating apparatus shown in FIG. 7.
Figure 9:
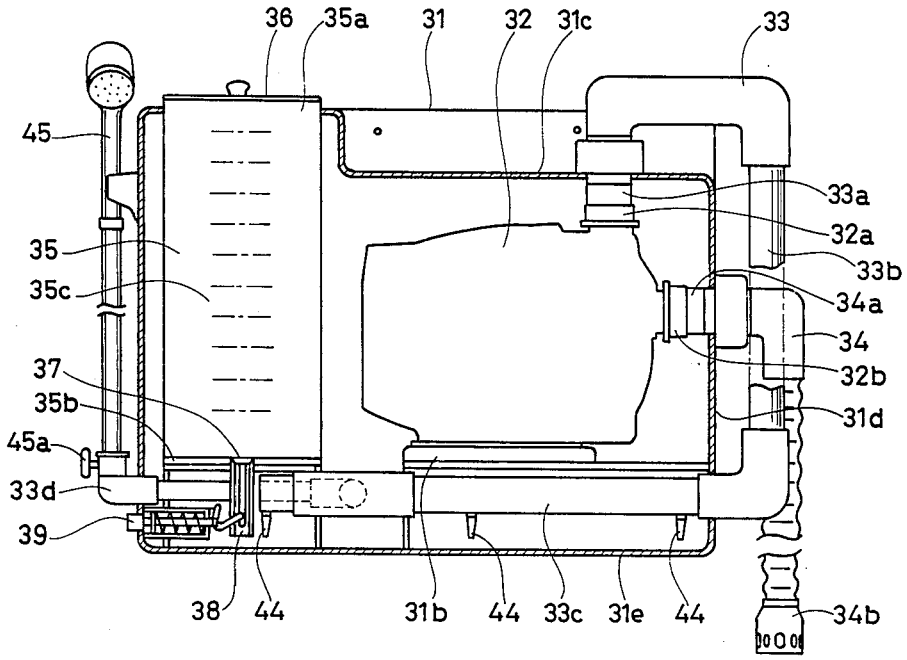
FIG. 9 is a partial sectional front view of the water current and air bubble generating appratus shown in FIG. 7.
Figure 10:
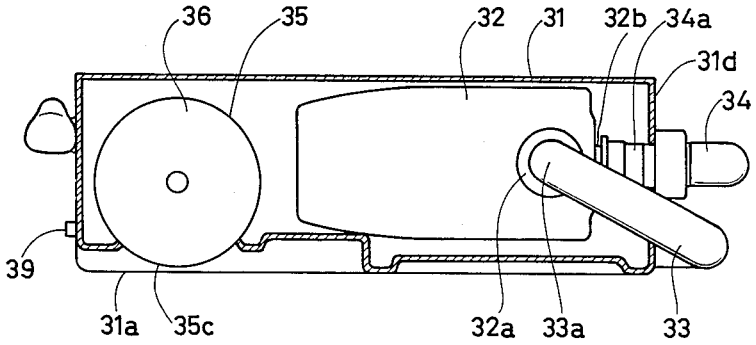
FIG. 10 is a partial sectional top view of the water current and air bubble generating apparatus shown in FIG. 7.
Figure 11:
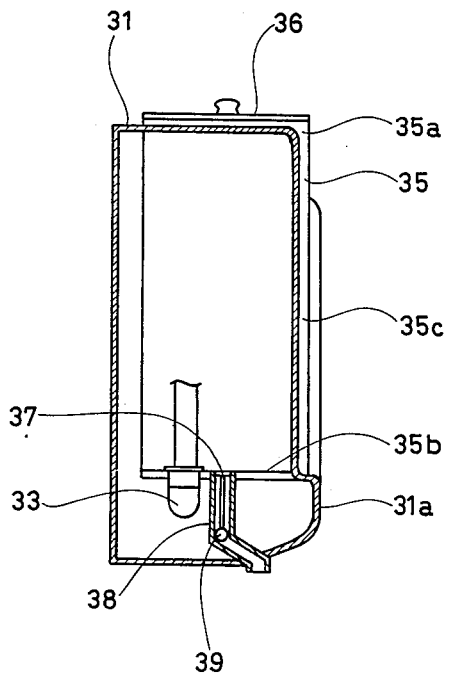
FIG. 11 is a partial sectional left side view of the water current and air bubble generating apparatus shown in FIG. 7.

Now, referring to FIGS. 7 to 11, another embodiment of this invention will be desbribed. FIG. 7 is a perspective view showing the state in which a water current and air bubble generating apparatus of another embodiment of this invention is installed in a bathroom. FIG. 8 is an enlarged perspective view of the above stated water current and air bubble generating apparatus. FIG. 9 is a partial sectional front view of the above stated water current and air bubble generating apparatus. FIG. 10 is a partial sectional top view of the above stated apparatus. FIG. 11 is a partial sectional left side view of the above stated apparatus.

The water current and air bubble generating apparatus 30 of this embodiment comprises as main parts, a main body case 31, a pump 32 containing a motor (referred to hereinafter as an electric pump), an outlet pipe 33 with jet nozzles and a suction pipe 34, in the same manner as in the embodiment shown in FIGS. 1 to 6.

The main body case 31 is in the form of a box and contains the electric pump 32 and an enzyme box 35. The enzyme box 35 is a cylindrical transparent recipient, a lid 36 being put in a detachable manner on the upper end 35*a* thereof. In the bottom 35*b* of the enzyme box 35, a supply pipe 38 having a valve 37 is provided downward. This valve 37 is opened and closed by means of a button 39 provided on a side face of the main body case 31. The front face portion 35*c* of the enzyme box 35 is exposed on the front face 31*a* of the main body case 31 so that the amount of enzyme contained therein can be checked from outside. As an enzyme to be filled in the box 35, a bath preparation on the market or the like is used. On the front faces 31*a* of the main body case 31, an acrylic mirror 40, a power source timer 41 for setting the operation time of the electric pump 32 and a thermo-hygrometer 42 are provided as shown in FIG. 8. The main body case 31 is placed on an edge portion 3*a* of the bathtub 3 and fixed to the wall 2*a* of the bathroom 2 by means of fixing screws 43, as shown in FIG. 7.

The electric pump 32 is fixed adjacent to the enzyme box 35 in the main body case 31. This electric pump 32 includes an outlet 32*a* in an upper portion and an inlet 32*b* in a side portion. To the outlet 32*a*, one end 33*a* of the outlet pipe 33 is connected. To the inlet 32*b*, one end 34*a* of the suction pipe 34 is connected. The power source of the electric pump 32 is applied from an outlet of commercial power source (not shown) and is turned on and off by the operation of the above stated power source timer 41.

The outlet pipe 33 is exposed outside the main body case 31, and extends downward from the upper portion 31*c* of the main body case 31 along the side portion 31*d* and then enters again into the main body case 31 from a lower portion of the side portion 31*d*, as shown in FIGS. 7 to 9. In the outlet pipe 33, the exposed portion 33*b* along the side portion 31*d* of the main body case 31 is formed by a transparent pipe so that the water flowing therein can be checked from outside. The horizontal portion 33*c* of the outlet pipe 33 extending along the bottom 31*e* of the main body case 31 is provided with jet nozzles 44 directed downward and spaced at predetermined intervals, the number of the nozzles 44 being for example three. The tip portion 33*d* of the outlet pipe 33 is connected with a shower apparatus 45, which is operated by rotating a cock 45*a*.

The above stated suction pipe 34 is exposed outside the main body case 31 and extends downward along the side portion 31*d* of the case 31. The suction pipe 34 is formed by a bellows pipe almost over the whole length thereof so as to be bent at any point. The tip portion of the suction pipe 34 is submerged in the hot water of the bathtub 3 and the submerged portion 34*b* of this tip portion has a filtering effect and can contain a radon generator for generating radon (radium-emanation).

In an arrangement as described above, when a suitable amount of enzyme is added to the hot water in the bathtub 3 by pressing the button 39 of the enzyme box 35 and the power source timer 41 is set to a fixed time, the electric pump 32 operates so that hot water in the bathtub 3 is sucked up through the suction pipe 34 and the hot water thus sucked up shoots as jet currents from the jet nozzles 44 of the outlet pipe 33 into the bathtub 3. When the power source tinmer 41 is turned off, the electric pump 32 automatically stops.

The number of jet nozzles 44 is not limited to the number in the above stated embodiment. It may be increased or decreased according to the size of the bathtub 3. It is the same with the embodiment of FIGS. 1 to 6.

In the embodiment shown in FIGS. 7 to 11, the ultrasonic wave effects by the jet current can be also obtained and in addition, the apparatus of this embodiment is very convenient since a suitable amount of bath preparation can be injected into the bathtub only by pressing the button 12.

Further, since a radon generator can be contained in the submerged portion **34*b* of the tip portion of the suction pipe 34**, the same effect as in a hot spring containing radon can be obtained in a family bathroom.

What is claimed is:

1. A water current and air bubble generating apparatus for bath designed to be used in association with a bathtub to be filled with water to a predetermined water surface level, said water current and air bubble generating apparatus being adapted for generating air bubbles in water in said bathtub and scattering said air bubbles in the whole area of said bathtub, said water current and air bubble generating apparatus comprising:

(a) a motor, (b) a pump driven by said motor, (c) a case containing at least said motor and said pump and located outside said bathtub, (d) a suction pipe having one end extending into said bathtub and the other end coupled to an inlet of said pump, (e) an outlet pipe having one end coupled to an outlet of said pump, at least a portion of said outlet pipe being located above said predetermined water surface level of said bathtub, (f) a jet nozzle coupled to said portion of said outlet pipe and positioned a predetermined distance above from said predetermined water surface level for shooting out, at least at a predetermined water flow rate, as jet current, water flowing in said outlet pipe downward to the surface of the water to be filled in said bathtub from said predetermined distance above said predetermined water surface level, said predetermined water flow rate of said jet current and said predetermined distance of said jet nozzle above said predetermined water surface level being selected to generate a large amount of air bubbles in the water when said jet current collides with the water surface at a predetermined water surface level, and (g) space defining means for defining a space from said jet nozzle to the water surface at said predetermined water surface level in said bathtub, said space defining means extending from said case and being in communication therewith, said space defining means being located to surround said jet current shot out from said jet nozzle to isolate said jet current from the external environment, said space defining means having a lower portion including an opening directed downward and extending into the water in said bathtub for allowing said jet current to be discharged into the water in said bathtub, (h) the inner diameter of said space defining means being selected to allow the inner wall of said space defining means to surround said jet current with a predetermined gap sufficient enought to allow said jet current to take a sufficient amount of air therein from said case to thrust onto the water surface of said bathtub, causing a sufficient amount of air bubbles in the water of said bathtub, (i) The length of said space defining means being selected to extend downward into the water in said bathtub to a predetermined depth from the water surface at said predetermined water surface level, thereby to cause almost all of the air bubbles generated in the water to be moved out from said opening into the water in said bathtub, (j) said water current and air bubble generating apparatus further comprising air passage allowing means for allowing passage of a necessary amount of air for generation of a large amount of air bubbles in said space defining mean, thereby to cause said space defining means to reduce a noise caused when said jet current shot out from said jet nozzle collides with the water surface at said predetermined water surface level.

2. A water current and air bubble generating apparatus for bath as set forth in claim 1, comprising at least a step-down transformer, a power source circuit for supplying electric power to said motor being provided outside a bathroom, and comprising a connection cord for connecting said power source circuit and said motor.

3. A water current and air bubble generating apparatus as set forth in claim 2, wherein said power source circuit comprises a rectifying circuit for rectifying the secondary output of said step-down transformer, and said connection cord connects said motor and an output terminal of said rectifying circuit.

4. A water current and air bubble generating apparatus as set forth in claim 1, wherein said case is installed on a wall of a bathroom, at a position higher than the water surface of said bathtub, and said portion of said outlet pipe extends along the lower face of said case.

5. A water current and air bubble generating apparatus as set forth in claim 4, wherein said space defining means is provided on the lower face of said case to communicate with the inside of said case through said air passage allowing means.

6. A water current and air bubble generating apparatus as set forth in claim 5, wherein said space defining means and said air passage allowing means are formed as a unitary cylinder, and said cylinder has an upper portion of a small diameter and a lower portion of a large diameter.

7. A water current and air bubble generating apparatus as set forth in claim 6, wherein the cross-sectional area of said upper portion of a small diameter is selected to be about 25 to 35% of the cross-sectional area of said lower portion of a large diameter.

* * * * *